United States Patent [19]

Edwards

[11] Patent Number: 4,995,018

[45] Date of Patent: Feb. 19, 1991

[54] METHOD AND APPARATUS FOR TIMING THE DELIVERY OF A SPEECH

[76] Inventor: Drew Edwards, 6075 The Corners Pkwy., Ste. 115, Norcross, Ga. 30092

[21] Appl. No.: 418,561

[22] Filed: Oct. 10, 1989

[51] Int. Cl.[5] ..... G04F 7/00

[52] U.S. Cl. ..... 368/107; 368/316; 368/317

[58] Field of Search ..... 368/89–113, 368/316, 317

[56] References Cited

U.S. PATENT DOCUMENTS

| | | | |
|---|---|---|---|
| 2,932,779 | 12/1954 | Tancig | 368/108 |
| 3,845,614 | 11/1974 | Christ | 58/19 A |
| 3,882,670 | 5/1975 | Wooley | 368/89 |
| 3,943,694 | 3/1976 | Hofer | 59/19 C |
| 4,238,847 | 12/1980 | Daly | 368/108 |
| 4,240,154 | 12/1980 | Sekine | 368/113 |
| 4,407,587 | 10/1983 | Fujita | 368/108 |
| 4,432,652 | 2/1984 | Munekata et al. | 368/69 |

FOREIGN PATENT DOCUMENTS

| | | | |
|---|---|---|---|
| 2261043 | 6/1974 | Fed. Rep. of Germany | 368/107 |
| 2008815 | 6/1979 | United Kingdom | 368/89 |
| 2196156 | 4/1988 | United Kingdom | 368/98 |

*Primary Examiner*—Bernard Roskoski
*Attorney, Agent, or Firm*—Thomas & Kerr

[57] ABSTRACT

A method and apparatus for timing the delivery of a speech comprises a rectangular case bearing a linear array of light emitting diodes arranged into three groups of different colors each corresponding to a portion of the speech. A microcontroller is configured to activate the LED's in sequence and adjustments are provided to control the rate at which LED's are activated within each group. The color of a presently activated LED informs the speaker at a glance which portion of the speech he should be delivering as well as the time remaining to complete such portion.

9 Claims, 3 Drawing Sheets

TST= TOTAL SPEECH TIME
FWT= FINAL WARNING TIME

METHOD AND APPARATUS FOR TIMING THE DELIVERY OF A SPEECH

TECHNICAL FIELD

This invention relates to public speaking and more particularly to a method an apparatus adapted to assist a public speaker in conforming to a preselected timing schedule while delivering a speech.

BACKGROUND OF THE INVENTION

When planned for delivery, a public speech is often organized into three distinct portions, namely the introduction, the body and the conclusion. In the introduction, a speaker usually greets his audience with light hearted comments often called ice breakers, introduces his topic and summarizes the contents of his speech. Main points and details of the selected topic are usually delivered during the body of the speech while issues and points-of-view presented by the speaker are often summed up and delivered in conclusory fashion during the conclusion of the speech.

Experience has shown that the total duration of a speech as well as the relative durations of its corresponding portions, i.e. the speech's time scheduling, can be critical to its effectiveness and to its ability to maintain a high level of interest among the audience. An effectively delivered one hour speech might, for example, be organized into an introduction lasting fifteen minutes, a body lasting thirty-five minutes and a conclusion lasting ten minutes. Significant deviations from the time schedule of the speech can and often does result in an ineffective delivery of what would otherwise be an interesting and effective speech. It is therefore highly desirable that a public speaker plan his speech carefully and pace himself when delivering the speech so as to maintain the predetermined critical time scheduling thereof.

In the past, public speakers, having previously planed the content of a speech to conform to a desired timing schedule, have commonly timed the actual delivery of the speech by simply glancing at a watch or clock occasionally and mentally calculating the total lapsed time since the beginning of the speech as well as the lapsed time since the beginning of each portion thereof. While this method is somewhat effective, the speaker's constant glancing at his watch can be distracting to him and to his audience. Further, the required mental calculations can interrupt the speaker's chain-of-thought further detracting from the effectiveness of his delivery. This is particularly true where the speech begins at an uneven time increment from which subsequent time periods are difficult to calculate quickly.

In some cases, speakers have attempted to avoid these problems by carefully planning and rehearsing a speech repeatedly prior to its delivery in an effort to assure its proper time scheduling upon delivery. This method, however, can be unreliable as it depends upon the environment and circumstances surrounding the actual delivery speech being substantially similar to those in which rehearsals have occurred. Further, unexpected interruptions such as audience questions can disrupt the speaker's pace and destroy the rehearsed timing of the speech making it virtually impossible for the speaker to adjust remaining portions of the speech to revive the original schedule.

A continuing and unaddressed need exists, therefore, for a method and embodying apparatus adapted to assist a public speaker in conforming to a preselected timing schedule while delivering a speech with such apparatus overcoming problems long associated with prior art methods. It is to the provision of such a method and apparatus that the present invention is primarily directed.

SUMMARY OF THE INVENTION

The present invention is a method and apparatus for assisting a public speaker in adhering to a preselected timing schedule during delivery of a speech. The apparatus comprises a case that can be supported on a speaker's podium with the case having a set of light emitting diodes (LEDs) disposed in a linear array on its face. A microcontroller within the case is coupled to the LEDs and configured for sequential lighting thereof beginning at one end of the array and continuing to the other. Adjustments are provided for setting a preselected rate at which LEDs are sequentially lit such that the timing of the progress of LED lighting along the linear array is manually controllable.

In use, a speaker sets the adjustments to correspond to a preselected timing schedule for the speech and activates the apparatus upon beginning the speech. While delivering the speech, the speaker need only glance at the progress of LED lighting along the linear array to be apprised of the preselected schedule and adjust his delivery pace accordingly to insure that actual speech delivery corresponds to the predetermined schedule. Preferably, the linear array is configured into 3 groups of differing colors each corresponding to one of the three portions of a speech further to apprise a speaker of his expected progress for each speech portion.

Thus, a method and apparatus is now provided that quickly and accurately apprises a public speaker of a preselected time schedule during actual delivery of a speech that overcomes problems long associated with the prior art. Additional features, objects and advantages will become apparent upon reviewing the following detailed description taken in conjunction with the accompanying drawings.

DETAILED DESCRIPTION OF THE PREFERRED EMBODIMENT

Figure 1:
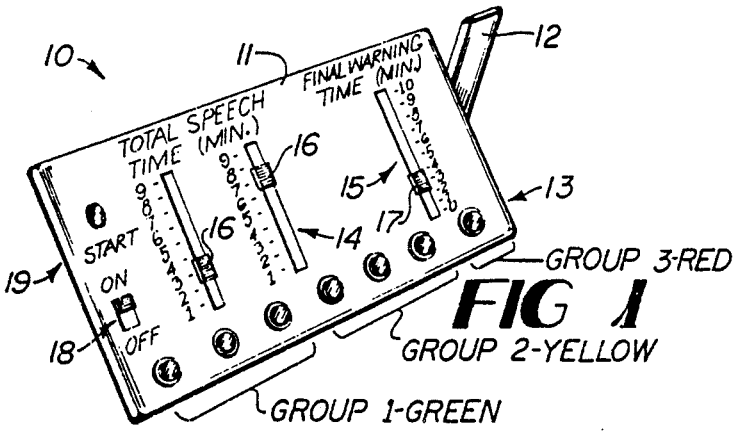
FIG. 1 is a perspective view of one embodiment of the apparatus of the invention illustrated as it might appear on a speaker's podium.
Figure 2:
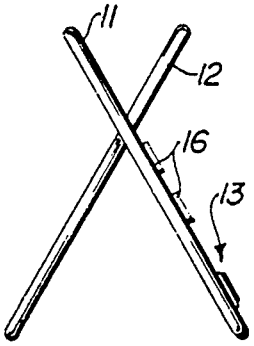
FIG. 2 is a side elevational view of the apparatus of FIG. 1 illustrating its integral pivoting support stand.
Figure 3:
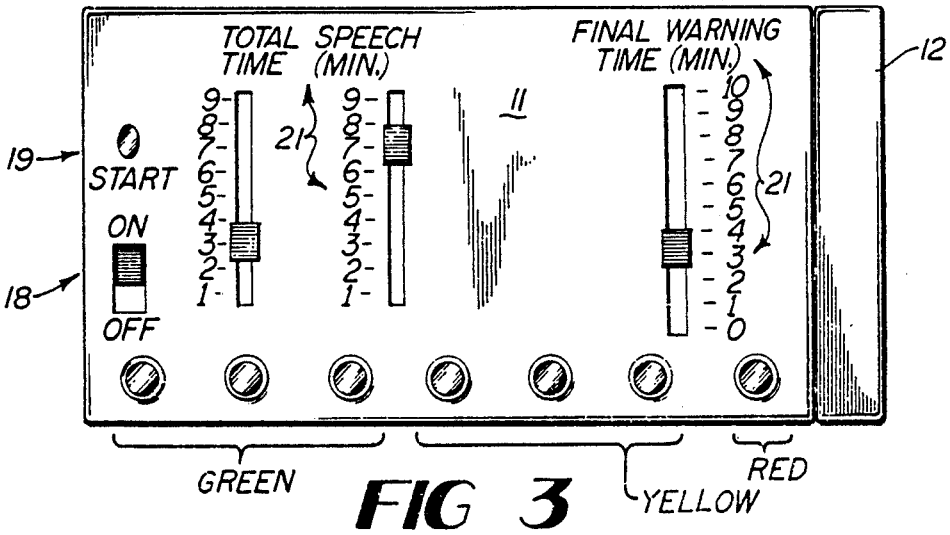
FIG. 3 is a front elevational view of the apparatus of FIG. 1 illustrating a preferred placement of is face components.

Referring now in more detail to the drawings, in which like numerals indicate like parts throughout the several views, FIGS. 1 through 3 illustrate an apparatus 10 that embodies principals of the invention in a preferred form. The apparatus 10 is seen to comprise a case 11 that preferably is sized to fit neatly into a user's pocket for carrying. A support member or stand 12 is pivotably attached to the case 11 at one end thereof and is adapted to pivot between a storage position coextensive with the body of the case 11 (FIG. 3) and a support position forming an angle with the case (FIGS. 1 and 2). When in its support position, the stand 12 supports the case 11 in an upright angled configuration upon a speaker's podium as shown such that the elements disposed on the face of the case are easily viewable by a speaker standing behind the podium.

A set of light emitting diodes (LEDs) 13 are disposed on the face of the case and are there arranged into a linear array extending adjacent and parallel to the bottom edge of the case. In the illustrated embodiment, the LEDs are organized into three contiguous groups of different colors, namely green, yellow and red, with the green group being made up of three green LEDs, the yellow group being made up of three yellow LEDs and the red group being made up of one red LED. While this particular LED arrangement is considered effective, it will be understood by skilled artisans that scores of varying arrangements comprising different total numbers of LEDs configured into various sized groups might be used with substantially identical results.

Timing adjustments 14 and 15 are disposed on the face of the case 11 with timing adjustment 14 comprising a pair of potentiometers having linearly movable knobs 16, each of which being manually locatable at a preselected position along its path of movement. Adjustment 15 comprises a single potentiometer having a linearly movable knob 17 that is manually locatable at a preselected position along its path of movement. Indicia 21 are printed adjacent the timing adjustments 14 and 15 and indicate the function of each adjustment and the time settings corresponding to preselected positions of the knobs 16 and 17. As described more fully hereinbelow, the timing adjustments 14 and 15 are used by a speaker to set the desired total duration of his speech as well as the desired duration of the final or conclusory portion thereof for corresponding sequentially activated control of the LEDs 13.

A power switch 18 is provided and configured in series with a battery power source (not shown) selectively to connect the apparatus to the power source for operation thereof. A start switch 19 is also provided and is adapted to initiate timing operation of the apparatus upon being pressed by a speaker, preferably coincident with the beginning of his speech.

Figure 4:
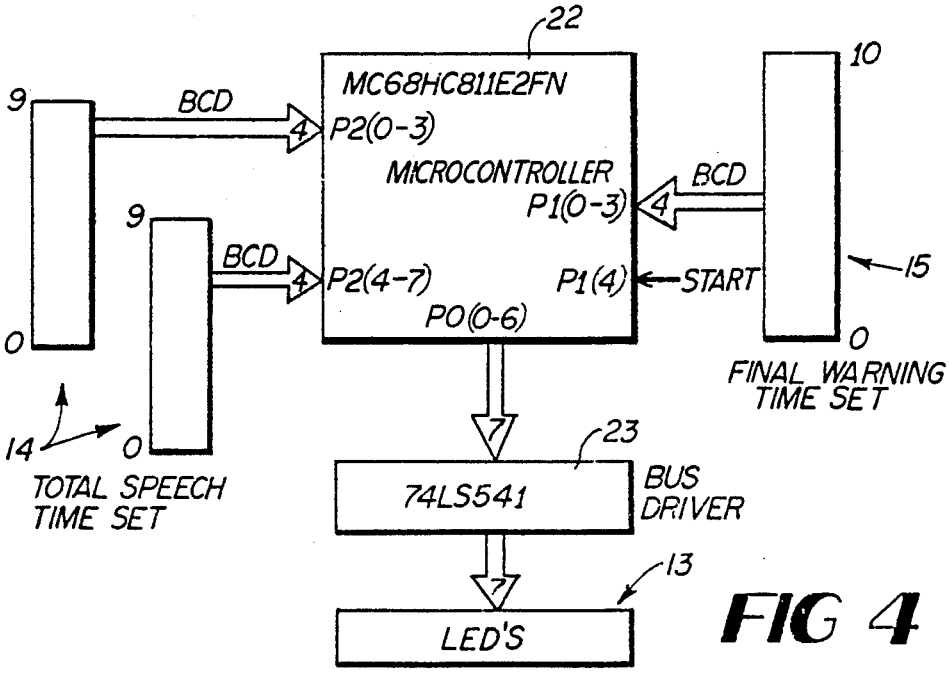
FIG. 4 is a schematic diagram illustrating interconnection of electronic components within the apparatus of the present invention.

FIG. 4 illustrates interconnection of electronic components within the case for controlling sequenced lighting of the LEDs. A microcontroller 22 such as chip model number MC68HC811E2FN available from the Motorola Semiconductor Corporation is electrically coupled at one of its I/O parts to the seven LEDs 13 through a bus driver 23. Conveniently, each LED is coupled to a corresponding pin of the I/O port, which here is configured as an output port. An LED can be lit, then, by a setting of the corresponding output port bit to a high voltage state. The bus driver 23, which is preferably a 74LS541 chip available from Motorola Semiconductor, is interposed between the output port PO and the LEDs simply to provide sufficient current to power the LED without unduly taxing the current capacity of the output port itself.

Adjustments 14 and 15 are coupled to the microcontroller for manual setting of the rate at which the LEDs are sequentially lighted. Preferably, each control comprises a linearly adjustable potentiometer coupled to a voltage source and an analog-to-digital (A/D) converter to produce a varying voltage at the analog input of the A/D converter with such voltage being proportional to the potentiometer adjustment position. The A/D converter, then, converts the voltage appearing at its input to a four bit binary coded decimal (BCD) signal that is electrically coupled to an I/O port of the microcontroller which is configured as an input port. With this configuration, a four bit binary number proportional to the adjusted position of each potentiometer is presented to and readable by the microcontroller. Alternatively, an electronic digital state machine could be used in place of the potentiometer and A/D converter.

In the illustrated embodiment, two such adjustments are coupled to I/O port 2 of the microcontroller with one being coupled to bits 0–3 of the port and the other being coupled to bits 4–7. Similarly, adjustment 15 is coupled to bits 0–3 of I/O port The microcontroller, appropriately programmed, can read the adjustment settings, which correspond to a desired timing schedule of a speech, and control the sequenced lighting of the LEDs accordingly. A start switch is coupled to bit 4 of I/O port 1 and, when activated, serves to instruct the microprocessor to begin sequenced lighting of the LEDs.

Figure 5:
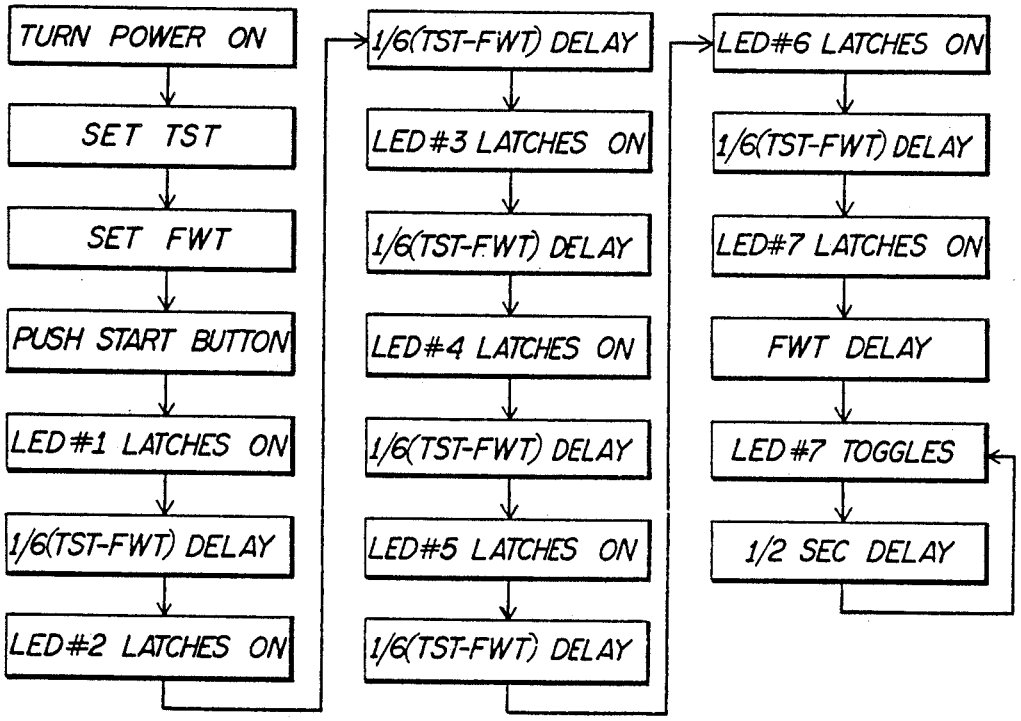
FIG. 5 is a functional flow diagram illustrating control of sequenced activation of the LEDs on the apparatus face to perform the method of the present invention.

FIG. 5 illustrates the functional flow of a software program that can be implemented in a microcontroller circuit configured as shown in FIG. 4 to perform the method of the invention in a preferred way. It will be obvious, however, that vast modifications might be made to illustrated flow, which is intended to show only one example. As illustrated, prior to delivering his speech, a speaker activates the power switch 18 (FIG. 1) and first sets the desired total duration of his speech or total speech time (TST) by adjusting the knobs 16 to proper corresponding positions. If, for example, the speaker wishes his speech to last forty five minutes, the first or left most adjustment in FIG. 3 would be positioned adjacent the numeral "4-" and the second adjustment positioned adjacent the numeral "5-", representing 45 minutes. Similarly, the desired final warning time (FWT) is set with the adjustment 15. The FWT in this embodiment represents the time in minutes prior to the end of the TST when the warning LED should be lit as described below. The speaker might, for example, wish to have the warning LED lighted 5 minutes before the end of his forty five minute speech, in which case the TST adjustments 14 would be set to "45" and the FWT adjustment set to "5".

With the desired time sequencing thus set, the speaker pivots the stand 12 to its support position and places the apparatus on the podium out of view of the audience but easily within his view from behind the podium. Upon beginning the speech, the start switch 19 is depressed, which begins sequenced lighting of the LEDs 13 according to the TST and FWT adjustment settings. Specifically, the first, or left-most LED in FIG. 3, is lighted upon activating the start switch. A delay time prior to lighting the next adjacent LED is then calculated, which, in the illustrated embodiment, is equal to one sixth of the difference between the preset total speech time and final warning time. In the example presented above, this delay time would be $1/6*(45-5)$ or $6\frac{2}{3}$ minutes. After dwelling for the calculated delay time, the next adjacent LED is lit whereupon the microcontroller again dwells before lighting the next adjacent LED. When the first 6 LED, comprising all LEDs of the green and yellow groups, have been thus sequentially lit, the final or right-most red LED in FIG. 3 is lit at the appropriate time prior to the end of the speech and is flashed or toggled to warn the speaker that the schedule for his speech is in its final or conclusion stage.

Thus, it can be seen that in operation, the LEDs are sequentially lit from left to right (FIG. 3) through the green group, which represents the introduction of the speech, the yellow group, representing the body of the speech, and finally to the red group, which represents the conclusion of the speech. While delivering the speech, then, the speaker can determine at a glance the progress of his preselected schedule for the speech and adjust his delivery pace accordingly to conform thereto. If, for example, the speaker sees that the fifth or middle yellow LED is lit, he knows that he should be at least half way through the body of his speech. No complex mental time calculations are required since information is conveyed to the speaker upon even a cursory glance. Further, if the speech is interrupted by an audience question or comment, the apparatus continues to display the preset schedule such that after the interruption, the speaker can increase the pace of his delivery or even omit less critical material to insure that in the end, the speech conforms to its preselected schedule.

Figure 6:
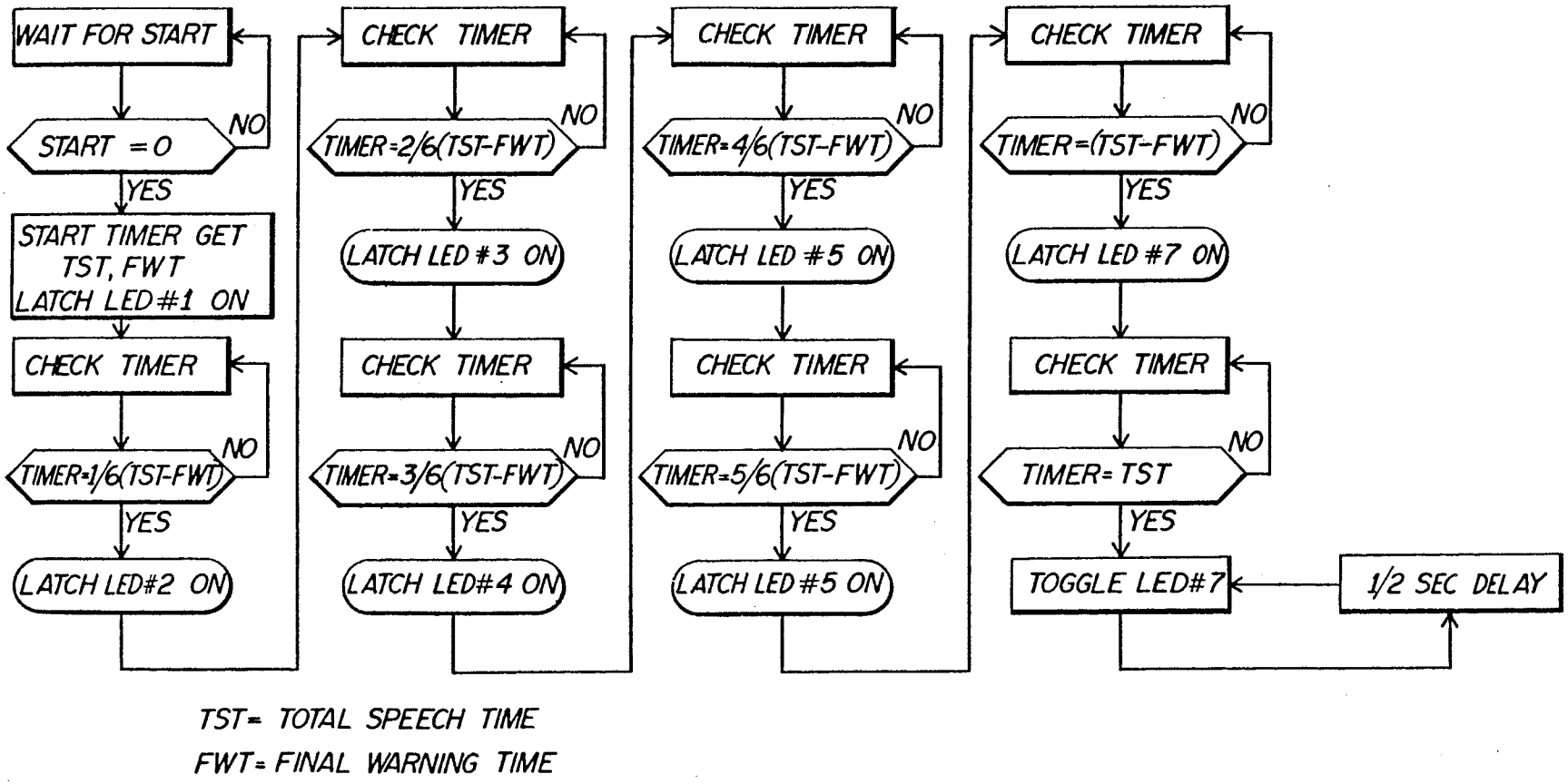
FIG. 6 is a detailed flow diagram illustrating one method of programming a microcontroller to perform the method of the present invention.

FIG. 6 illustrates the method shown in FIG. 5 in a more formal flowchart form of the type that might be used by a programmer in designing the software program to be implemented in the microcontroller. Such flowcharts are easily comprehended by skilled artisans such that detailed discussion is not required here. FIG. 6 is presented as an enabling guide to a programmer implementing the method of the invention.

The invention has been described in terms of preferred embodiments. The nature of the invention, however, renders it susceptible to broad variations that will be obvious to persons skilled in the art. Many more LEDs in much closer proximity might, for example, be used in place of the seven illustrated. In addition, the first LED of each group could be activated a predetermined time after the beginning of the speech part corresponding to that group instead of concurrently with such beginnings. Other means of indicating the passage of time might also be used in place of LEDs such as a digital or analog display of lapsed or remaining time. While in the preferred embodiment LEDs are lit sequentially through both the first and second groups at the same rate, a third adjustment could easily be provided to set a desired relative rate of lighting within each group such that, for example, the scheduled time durations of the introduction and body of the speech would be different. Further, the invention could easily be incorporated into a common calculator. In such a combination, the calculator's display could serve as the display means in the speech timing mode or a separate set of displays could be provided elsewhere on the calculator. These and other modifications, additions and deletions could be made to the illustrative embodiments without departing from the spirit and scope of the invention as set forth in the claims.

I claim:

1. An apparatus for timing the delivery of a speech of the type composed of at least two distinct timed portions with said apparatus comprising:

a case sized and configured to be carried in the pocket of a user and having a face;

means for supporting said case upon a podium with its face oriented toward a speaker behind the podium;

a first array of light emitting elements prominently displayed on said face and arranged to indicate the progressive lapse, of the first timed portion of the speech when activated in a predetermined sequence;

a second array of light emitting elements prominently displayed on said face and arranged to indicate the progressive lapse of the second timed portion of the speech when activated in a predetermined sequence subsequent to activation of said first array of light emitting elements;

electronic control means coupled to said first and second arrays of light emitting elements and adapted to activate said first array in a predetermined sequence to indicate the progressive lapse of the first timed portion of the speech and subsequently to activate said second array in a predetermined sequence to indicate the progressive lapse of the second timed portion of the speech;

adjustable means coupled to said control means for selecting the timing of sequenced activation of said first and second arrays of light emitting elements; and means for selectively activating said control means to initiate sequenced activation of said first and second arrays of light emitting elements;

a third light emitting means prominently displayed on said face for indicating the lapse of a third timed portion of the speech, said control means being coupled to and adapted to activate said third light emitting means a predetermined time prior to the end of the speech, and second adjustable means coupled to said control means for selecting the time for activation of said third light emitting means.

2. The apparatus of claim 1 wherein said first array of light emitting elements comprises a first set of light emitting diodes arranged in a linear configuration on said face and wherein said control means is adapted to activate said first set of light emitting diodes in linear sequence to indicate the progressive lapse of the first timed portion of the speech.

3. The apparatus of claim 2 wherein said second array of light emitting elements comprises a second set of light emitting diodes arranged in a linear configuration on said face and wherein said control means is adapted to activate said second set of light emitting diodes in linear sequence subsequent to the activation of said first set of light emitting diodes to indicate the progressive lapse of the second timed portion of the speech.

4. The apparatus of claim 3 wherein said first and second linear arrays of light emitting diodes are coextensive and disposed along one edge portion of said face.

5. The apparatus of claim 4 wherein said first set of light emitting diodes emit light of a first color upon activation and wherein said second set of light emitting diodes emit light of a second color upon activation.

6. The apparatus of claim 1 wherein said electronic control means comprises a microcontroller having input and output ports and wherein said adjustable means comprises at least one selectively adjustable potentiometer coupled to an input port of said microcontroller, said microcontroller being adapted to sense the condition of the said potentiometer and activate said first and second arrays of light emitting elements according to the sensed condition.

7. The apparatus of claim 6, and wherein said potentiometer is linearly adjustable and includes a knob protruding from the face of said case for manual adjustment of said potentiometer.

8. The apparatus of claim 1 and wherein said case is substantially rectangular having opposed side edges and opposed end edges and wherein said means for supporting said case upon a podium comprises a stand pivotally attached to one end edge of said case and being movable between a first position wherein said stand is coextensive with said case for storage and a second position wherein said stand extends rearwardly of said case for supporting the case on a podium with its face disposed in an inclined orientation.

9. An apparatus for timing the delivery of a speech of the type composed of at least two distinct timed portions with said apparatus comprising:

a substantially rectangular case having opposed side edges and opposed end edges and sized to be carried in the pocket of a user, said case defining a rectangular face on one side thereof;

a stand pivotally attached to one end edge of said case with said stand being movable between a first position wherein said stand is substantially coextensive with said case for storage and a second position wherein said stand extends rearwardly of said case for supporting the case on a podium with its face disposed in an inclined orientation toward a speaker behind the podium;

a first set of light emitting diodes prominently displayed on said face and arranged in a linear array along one side edge of said face;

a second set of light emitting diodes prominently displayed on said face and arranged in a linear array that is substantially coextensive with the linear array of said first set of light emitting diodes;

an electronic microcontroller disposed in said case and coupled to activate said first set of light emitting diodes in linear sequence to indicate the progressive lapse of the first timed portion of the speech and subsequently to activate said second set of light emitting diodes in linear sequence to indicate the progressive lapse of the second timed portion of the speech;

at least one selectively adjustable potentiometer having a manual adjustment knob disposed on said face with said potentiometer being coupled to said microcontroller, said microcontroller being adapted to sense the condition of said potentiometer and activate said first and second set of light emitting diodes according to the sensed condition; and switch means for selective initiation of sequenced activation of said first and second sets of light emitting diodes.

* * * * *